United States Patent [19]

Stoller

[11] Patent Number: 4,659,080

[45] Date of Patent: Apr. 21, 1987

[54] RACQUET HANDLE

[76] Inventor: Leo D. Stoller, 3113 N. Central Ave., Chicago, Ill. 60634

[21] Appl. No.: 505,779

[22] Filed: Jun. 20, 1983

[51] Int. Cl.[4] ..... A63B 49/08

[52] U.S. Cl. ..... 273/75

[58] Field of Search ..... 273/75, 735, 72 R, 81.3; D21/210-213, 221, 222

[56] References Cited

U.S. PATENT DOCUMENTS

| | | | |
|---|---|---|---|
| 3,545,755 | 12/1970 | Owada | 273/73 J |
| 3,547,440 | 12/1970 | Deer | 273/73 J |
| 4,038,719 | 8/1977 | Bennett | 273/81 R X |
| 4,147,348 | 4/1979 | Lee | 273/75 |
| 4,402,508 | 9/1983 | Pflueger | 273/73 J |

FOREIGN PATENT DOCUMENTS

| | | | |
|---|---|---|---|
| 11615 | 2/1928 | Australia | 273/75 |
| 5457 | of 1884 | United Kingdom | 273/75 |
| 8904 | of 1885 | United Kingdom | 273/73 J |

OTHER PUBLICATIONS

"Directions", The Sporting Goods Dealer, Jul. 1982.
"What's New", Popular Science, Jan. 1982.

*Primary Examiner*—Richard C. Pinkham
*Assistant Examiner*—Matthew L. Schneider
*Attorney, Agent, or Firm*—Richard J. Myers & Assoc.

[57] ABSTRACT

A racquet for use in tennis and racquet ball having an offset handle having an angular deviation of 13° with respect to the longitudinal axis of the racquet. The handle may have a cross-sectional area having a round or oval shape. The oval configuration has a major axis which is in the same plane as a head of the racquet. Alternatively the handle can be provided, in cross section, with a plurality of faces preferably arranged in opposing pairs, the faces extending longitudinally of the handle. Preferably, the multi-sided configuration defines a cross-sectional hexagonal form which extends from the point of attachment to a head of the racquet to the free end of the handle.

12 Claims, 6 Drawing Figures

RACQUET HANDLE

BACKGROUND OF THE INVENTION

1. Field of the Invention

This invention is generally concerned with athletic equipment and more particularly with rackets. Used in the play of tennis or racquetball and more specifically to an offset handle on such rackets.

2. Description of the Prior Art

The use of offset handles on tools for improving gripping of the tool by a user is generally known. For example, U.S. Pat. No. 4,038,719 described as a handle for tools and sporting equipment, or in the extremity on the tool is angularly offset to improve the gripping quality of the tool. Another form of a offset handle for a cooking pan or similar article is disclosed in U.S. Pat. No. Des. 104,484. Although tennis rackets having offset handles are available on the market, it has been found that the angular deviation of the handle portion with respect to the longitudinal axis of the racket is rather extreme causing fatigue in the arm of a tennis player and not developing maximum power in serving the ball and returning the ball. The development of the offset handle and rackets has proceeded in a haphazard manner without any scientific data being developed to determine the proper angularity of the offset handle.

SUMMARY OF THE INVENTION

The present invention provides an offset handle on a device, such as a tennis or a racquetball racket to reduce the fatigue of the arm of the player and to improve the hitting quality of the racket in serving and returning the ball during play. During extensive development status, it was determined that an offset handle having an angular deviation of 13° from the longitudinal axis of the racket achieved the desired reduction in fatigue and improved the hitting quality of the racket.

The primary object of the invention is to provide an offset handle for a racket, the offset handle having a 13° deviation from the longitudinal axis of the racket.

Another object of the invention is to provide an offset handle which improves the hitting efficiency of the racket with no increase in the muscular fatigue on the player's arm.

The foregoing and other advantages and features of the invention will become apparent from the following detailed description of an illustrated embodiment of the invention when taken in connection with the accompanying drawings.

DETAILED DESCRIPTION OF A PREFERRED EMBODIMENT OF THE INVENTION

Figure 1:
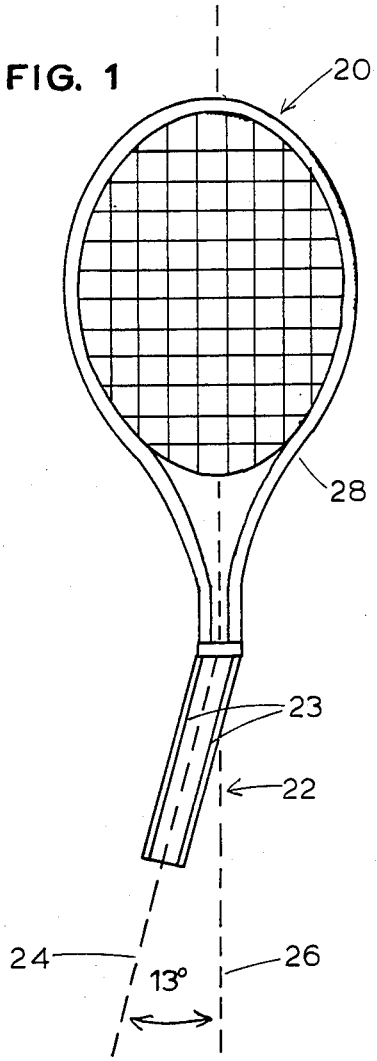
FIG. 1 is a plan view of a tennis racket provided with a 13° offset handle.

Referring to FIG. 1, there is shown a tennis racket 20 provided with an offset handle 22 having an angular deviation of 13° as developed between the longitudinal axis 24 passing through the handle 22 and the longitudinal axis 26 passing through the tennis racket 20. Both axis 24 and 26 are in the plan of the head 28.

The handle 22 may possess any desirable cross-sectional area such as a square, oval, octogonal or other. Preferably, the handle 22 is provided with a plurality of sides or faces 23 which expand longitudinally along the handle 22. The multi-sided faces 23 may have an even or an odd number of faces. Preferably, the faces are even in number and space in pairs, the faces in each pair being planar to each other. Although not shown, the handle 22 is generally wrapped with a shock absorbing tape or some other material forming a skin over the handle. If the cross-sectional area of the handle 22 is oval, the major axis of the oval would lie in the same plane as the head 20.

In order to compare the handling and the player playing quality of an offset handle tennis racket with a straight handle tennis racket, it was necessary to determine the angular deviation of the offset handle to improve the playing quality of the tennis racket with least exertion on part of the player. It was determined essentially that an offset handle of 13° gave the best performance. Extensive tests were performed such have been grouped into three phases as follows:

Phase 1: Comparison of 13° offset handle racket with a straight handle racket analysis of both speeds, hand and arm action during forehand and backhand drives.

Phase 2: Testing of an intermediate level tennis player.

Phase 3: Comparison of balls speed of forehand and backhand drive rise and services utilizing offset handle tennis racket and a straight handle tennis racket.

1.

CHARACTERISTICS OF THE RACQUETS

The racquets were selected of similar size and shape. The straight handled racquet (Wilson Sting) was of graphite construction. The Sentra 13° offset handle was the Powergrip. To determine the differences between the racquets a series of tests were conducted. Pertinent physical dimensions were measured by means of a metal tape measure and the weights were measured with a spring scale. These data appear in Table 1

A.

COEFFICIENT OF RESTITUTION

A rebound test was used to determine the coefficient of restitution between the tennis balls and each racquet face. Twenty drop trials were made at two different heights. Two tennis balls and two readers were used for ten trials each at the two heights. A yard stick was taped to a wall behind the drop path and the reader recorded the height of rebound from the racquet face set at zero height. The racquet handle was held against a chair seat with the hand to simulate the rigid hand-held position during play. Resuls are given in Tables 2 and 3.

TABLE 2

Rebound heights and coefficients of restitution of tennis ball dropped 17.5 inches onto straight handled and off-set handled tennis racquets. Rebound heights are in inches.

| | SH | OH | Difference OH − SH |
|---|---|---|---|
| Mean rebound of 20 trials | 4.6 | 5.3 | +0.9 |
| Standard deviation coefficient of restitution | 0.57 | 0.67 | +10 |

TABLE 3

Rebound heights and coefficients of restitution of tennis ball dropped 65.25 inches unto straight handled and off-set handled tennis racquets. Rebound heights are in inches.

| | OH(13°) | SH | Difference OH − SH |
|---|---|---|---|
| mean rebound of 20 trials | 9.3 | 7.8 | +1.5 |
| standard deviation | 2.0 | 1.4 | +0.6 |
| coefficient of restitution | 0.46 | 0.4 | +.42 |

Results of these coefficient of restitution tests indicate that the Sentra Powergrip tennis racquet has a substantially increased coefficient of restitution over the straight handle tennis racquet.

Results of these tests do indicate that the 13° offset handle tennis racquet has substantial advantages over the straight handle. The offset handled racquet has the advantage of being longer and thus capable of producing greater linear speed at the racquet face, which is transferred to the tennis ball. The collision between the ball and the racquet is more effective for the offset racquet than the straight handled racquet because its weight (and therefore its mass) produces a more effective transfer of momentum.

Given these theories of motion and the characteristics of the racquets, one would expect the offset racquet to respond quicker to the players use and that there would be a significant difference between the speed of the tennis ball after hit by the offset handled racquet suggesting the difference would be highly in favor of the offset racquet.

II.

CHARACTERISTICS OF THE SUBJECT

The subject had been a competitive tennis player in his youth and continues to participate in club tennis. He has coached for more than fifteen years and is presently coaching both the men's and women's university team.

PHASE ONE

Figure 2:
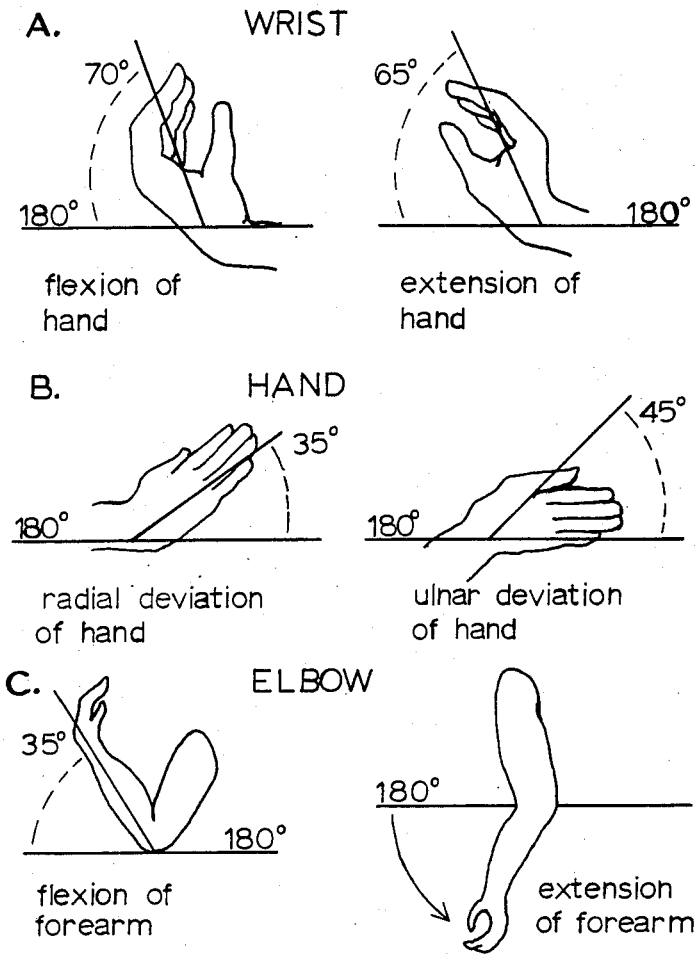
FIG. 2 depicts different positions on a wrist, hand and elbow for determining fatigue factors during tennis play.

The pertinent information concerning the range of motion at the wrist and elbow joints are illustrated in FIG. 2, which illustrates the range of motion utilized in the forehand and backhand rise with potential ranges. The movements of the wrist, flexion and extension, are shown in FIG. 2(A); the radial and ulnar deviation of the hand are shown in FIG. 2(B); and the flexion and extension of the forearm at the elbow, are shown in FIG. 2(C).

III.

TEST PROTOCOL-RESULTS

The following procedures and instrumentation were developed and used using an intermediate tennis player as the subject. Sensors in the form of electrogoniometers (elgons) were placed on the hand and arm to monitor the movements at the wrist, hand and elbow joints during the execution of the tennis drives.

Figure 4:
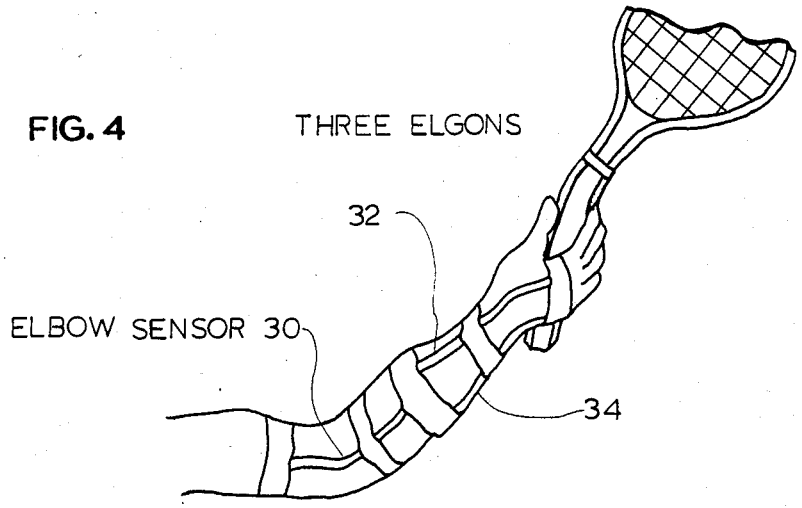
FIG. 4 is an illustration of a tennis player's hand gripping a tennis racket and showing the disposition of sensors on the player's hand for detecting the ranges of movement of the hand.

In FIG. 4, sensor 30 monitors the movement at the elbow, sensor 32 monitors the radial-ulnar deviation and sensor 34 is associated with the movement of the flexion-extension of the wrist. The sensors 30, 32, and 34 comprise potentiometers and straight or hinged chassis.

Figure 5:
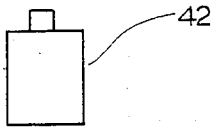
FIG. 5 is a block diagram of electrical equipment used to measure the output of the sensors attached to the subject's hand.
Figure 5:
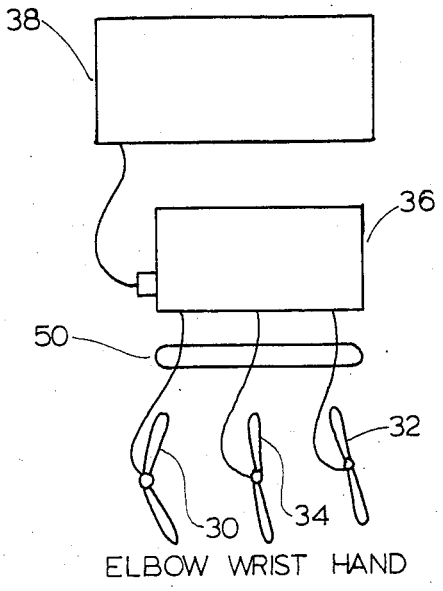
Figure 6:
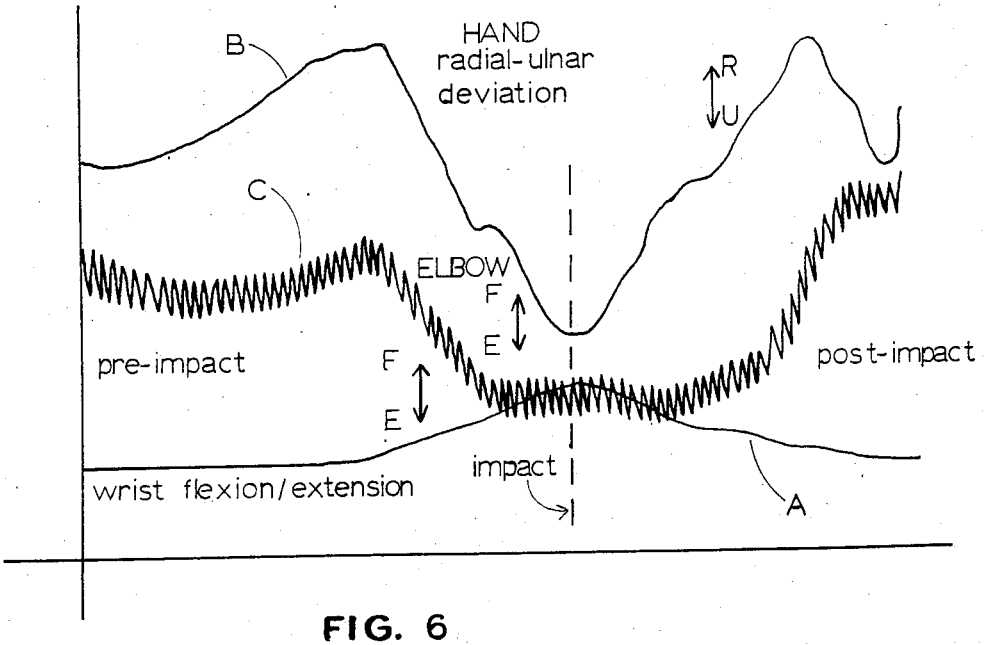
FIG. 6 is a sample goniogram obtained with the electrical arrangement shown in FIG. 5.

As shown in FIG. 5, the sensors 30, 32 and 34 are connected to a power supply 36 which is coupled to a recorder 38. The changes in the resistance through the sensors is detected on the recorder 38 by means of a change in a light trace on a graph paper, as shown in a sample goniogram in FIG. 6. [A better view of the attachments of the sensors 34 and 32 to the subject's hand is shown in FIGS. 5 and 6, respectively.] Referring to the goniogram shown in FIG. 6, is will be seen that movements of the hand are measured through the entire range of movement of the hand. In other words, as the hand moves the tennis racquet to strike the ball, this is identified as the pre-impact period; as the racquet strikes the ball, the impact period; and the follow through of the hand is identified as the post-impact period. A curve depicts the wrist flexion-extension, as identified by a vertical two-headed arrow showing the direction of flexion F and the extension E. Curve B is associated with the radial-ulnar deviation of the hand and the two motions are identified by a vertical double-headed arrow which indicates the radial deviation R and ulnar deviation U. Curve C is associated with the elbow to indicate the movement of the fore arm as it flexes or extends, the direction of which is indicated by a vertical double-headed arrow indicating flexion F and extension E.

Figure 3:
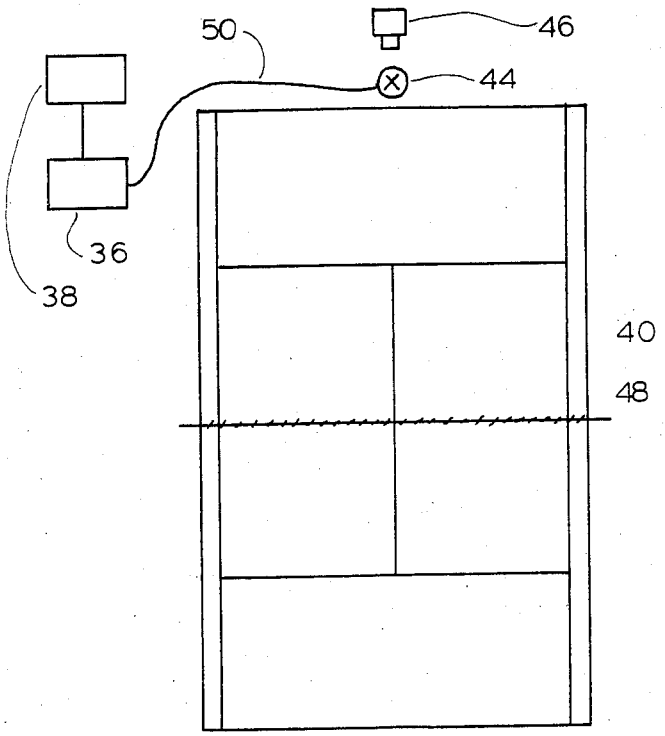
FIG. 3 is a plan view of a tennis court and laboratory equipment for testing rackets provided with straight and offset handles.

The testing of the two tennis racquets were conducted on a regulation size court court 40, as shown in FIG. 3. At one end of the court 40, a ball machine 42 was positioned for firing tennis balls at a tennis player positioned in position 44. A radar gun 46 operated by an observer was located behind the tennis player for taking readings of the velocity travel of the tennis ball fired by the ball machine 42 and returned by the tennis player over a net 48. The sensors mounted on the tennis player's arm were coupled by a light and flexible cable 50 recorder 38.

The subject practiced hitting with both racquets and with the sensors attached in order to accustom himself to the instrumentation. The cable 50 from the sensors to the recorder 38 was attached to the subject's waist and then dropped to the ground behind him. There was no interference of the cable with the performance of the subject.

The subject performed 40 forehand and backhand drives initiated by a self dropped ball. In groups of five each, the subject alternated between the 13° offset handled and straight handled racquets and between forehand and backhand drives. The order is given below:

Offset handle, forehand: 1–5
Straight handle, forehand: 1–5
Straight handle, backhand: 1–5
Offset handle, backhand: 1–5
Straight handle, forehand: 6–10
Offset handle forehand: 6–10
Straight handle, backhand: 6–10
Offset handle, backhand: 6–10

The subject then practiced with the ball machine 42 and performed 40 forehand and backhand drives. In some cases additional trials were necessary due to inaccuracy of the ball projection from the ball machine, or "poor" hit by the performer. The order is given below:

Straight handle, forehand: 1–5
Offset handle, forehand: 1–5
Offset handle, backhand: 1–5
Straight handle, backhand: 1–5
Straight handle, forehand: 6–10
Offset handle, forehand: 6–10
Offset handle, backhand: 6–10
Straight handle, backhand: 6–10

Prior to each forehand or backhand drive a ready signal was given and the subject began the stroke. Simultaneously the research team activated the recorder 38 to obtain continuous readings of the angles at the wrist (flexion and extension of the hand, radial and ulnar deviation of the hand) and at the elbow (flexion and extension of the forearm).

An assistant aimed the radar gun and read the speed of the ball. A second assistant recorded the speed of the ball and wrote comments concerning the performance; such as "low or right".

A.

COMPARISON OF THE SPEED OF THE BALL AFTER IMPACT WITH THE RACQUET

The results of the speeds of the ball for the four conditions (forehand/self-drop, forehand/ball machine, backhand/self-drop, and backhand/ball machine) are given in Table 4.

TABLE 4

COMPARISON OF BALL SPEEDS

| Condition | SH | OH(13°) | Difference OH – SH |
|---|---|---|---|
| Forehand | | | |
| Self drop | | | |
| range | 52–57 | 59.8–71.3 | 10.6 |
| mean | 54.9 | 65.5 | |
| s.d. | 1.5 | 2.0 | |
| Ball machine | | | |
| range | 31–55 | 47–64 | 12.7 |
| mean | 43.0 | 55.7 | |
| s.d. | 6.6 | 5.9 | |
| Backhand | | | |
| Self drop | | | |
| range | 51–54 | 54–65 | 3.8 |
| mean | 53.0 | 56.3 | |
| s.d. | 1.05 | 3.01 | |
| Ball machine | | | |
| range | 40–44 | 46–51 | 6.3 |
| mean | 42.0 | 48.3 | |
| s.d. | 1.4 | 2.9 | |

In all cases, the variability was greater with the offset racquet. The ranges means, and standard diviations (s.d.) for all trials were calculated and differences between the 13° offset racquet and the straight handled racquet were determined. In each condition the offset handled racquet yielded a greater mean ball speed. The differences were greater when balls were hit from the ball machine and forehand differences were greater than backhand differences.

The subject did not attempt to hit the ball as fast as possible since fatigue would have interferred with the results. The subject did however attempt to hit "strong, game strokes". Thus one can conclude that the 13° offset racquet is much more effective in producing forehand and backhand drives than a straight handle racquet or any handle with a bend greater than 13°.

B.

COMPARISONS OF FLEXION AND EXTENSION AT THE ELBOW DURING FOREHAND DRIVES (BALL MACHINES CONDITION)

The typical pattern of flexion and extension at the elbow is shown by Graph C in FIG. 8. The patterns were not the same for performance action for each racquet. From a flexed arm set-position, the arm extends partially in the backswing, and extends in the foreward swing to nearly complete extensions at impact (contact with the ball). After impact the arm flexes again.

The actual values of the angle at the elbow were measured and compared at three points in time: (1) greatest flexion prior to impact; (2) impact; and (3) greatest flexion after hit. These data are shown in Table 5.

TABLE 5

COMPARISON OF ELBOW POSITIONS: FOREHAND

| Condition | SH | OH(13°) | Difference OH – SH |
|---|---|---|---|
| Preimpact (Degrees of flexion) | | | |
| mean | 47 | 51 | 4 |
| s.d. | 4.4 | 3.9 | |
| Impact (Degrees of flexion) | | | |
| mean | 4 | 4 | 0 |
| s.d. | 2.2 | 1.5 | |
| Postimpact (degrees of flexion) | | | |
| mean | 40 | 44 | 4 |
| s.d. | 6.8 | 8.8 | |

Since patterns and measured angles did differ significantly during performances with the two racquets, the conclusion is that the offset handle did influence the movement of the forearm with respect to flexion and extension at the elbow, reducing muscle shock, while allowing the player to hit faster balls with less muscle fatigue than possible with a straight hand racquet.

C.

COMPARISONS OF FLEXION AND EXTENSION AT THE WRIST DURING FOREHAND DRIVES (BALL MACHINE CONDITION)

The typical pattern of flexion and extension at the wrist is shown by Graph A in FIG. 6. The general pattern for both tennis racquet conditions was the same. The hand hyperextended on the backswing and then proceeded to flex during the forward swing. Measurements were taken at three points in time: (1) greatest extention during preimpact; (2) impact; and (3) greatest flexion after impact. These data are presented in Table 6.

TABLE 6

COMPARISON OF WRIST FLEXION AND EXTENSION: FOREHAND

| Condition | SH | OH(13°) | Difference OH – SH |
|---|---|---|---|
| Preimpact (degrees of extension) | | | |
| mean | 33 | 37 | 4 |
| s.d. | 2.6 | 3.3 | |
| Impact | | | |

TABLE 6-continued

| COMPARISON OF WRIST FLEXION AND EXTENSION: FOREHAND | | | |
|---|---|---|---|
| Condition | SH | OH(13°) | Difference OH − SH |
| (degrees of flexion) | | | |
| mean | 1.8 | 4 | 2.2 |
| s.d. | 2.9 | 5 | |
| Postimpact (degrees of flexion) | | | |
| mean | 6 | 1 | −5 |

These data indicate that there were significant differences between the action at the wrist with respect to flexion and extension of the hand during the forehand drive (ball machine condition) when using the straight handled and offset tennis racquets, the offset 13° handle tennis racquet produces less stress and feels more natural.

D.

COMPARISONS OF RADIAL AND ULNAR DEVIATION OF THE HAND DURING FOREHAND DRIVES (BALL MACHINE CONDITION)

The typical pattern of radial and ulnar deviation of the hand is shown by Graph B in FIG. 6. The pattern of radial and ulnar deviation of the hand was different both racquet conditions. The hand was radially deviated during the backswing and then moved back to neutral and to ulnar deviation prior to impact. After impact the hand remained in ulnar deviation or returned to neutral if returning to the set-position.

Measurements were taken at three instances: (1) greatest radial deviation prior to impact; (2) impact; and (3) greatest ulnar deviation after impact. These data appear in Table 7. Again the data show significant differences between the two racquet conditions.

TABLE 7

| COMPARISON OR RADIAL AND ULNAR DEVIATION AT THE WRIST: FOREHAND | | | |
|---|---|---|---|
| Condition | SH | OH(13°) | Difference OH − SH |
| Preimpact radial deviation (in degrees) | | | |
| mean | 21 | 22 | 1 |
| s.d. | 3.3 | 3.8 | |
| Impact ulnar deviation (in degrees) | | | |
| mean | 29 | 26 | −3 |
| Postimpact ulnar deviation (in degrees) | | | |
| mean | 26 | 24 | −2 |
| s.d. | 7.2 | 7.2 | |

E.

COMPARISONS OF FLEXION AND EXTENSION AT THE ELBOW DURING BACKHAND DRIVES (BALL MACHINE CONDITION)

The typical pattern of flexion and extension at the elbow resembled that of the forehand as shown by the Curve C in FIG. 8. The measured data are given in Table 8.

TABLE 8

| COMPARISON OF ELBOW POSITIONS: BACKHAND | | | |
|---|---|---|---|
| Condition | SH | OH(13°) | Difference OH − SH |
| Preimpact (degrees of flexion) | | | |
| mean | 34 | 32 | −2 |
| s.d. | 4.5 | 4.4 | |
| Impact (degrees of hyperextension) | | | |
| mean | 2 | 1 | −1 |
| s.d. | 1.1 | 2.8 | |
| Postimpact (degrees of flexion) | | | |
| mean | 33 | 33 | 0 |
| s.d. | 4.9 | 8.1 | |

Although there is less flexion during the backhand stroke than during the forehand stroke, there is a substantial difference in muscle shock when using the Sentra 13° offset handle racquet as opposed to the conventional straight handle.

F.

COMPARISONS OF FLEXION AND EXTENSION AT THE WRIST DURING BACKHAND DRIVES (BALL MACHINE CONDITION)

The measured angles and the differences are presented in Table 9.

TABLE 9

| COMPARISON OF WRIST FLEXION AND EXTENSION: BACKHAND | | | |
|---|---|---|---|
| Condition | SH | OH(13°) | Difference |
| Preimpact (degrees of extension) | | | |
| mean | 31.8 | 36.5 | 15.3 |
| s.d. | 5.4 | 5.7 | |
| Impact | | | |
| mean | 5 flexion | 4 extension | −9 |
| s.d. | 10.8 | 7.3 | |
| Postimpact (degrees of extension) | | | |
| mean | 15.0 | 23.7 | 8.7 |
| s.d. | 7.3 | 11.9 | |

Differences between the two racquet conditions existed with respect to flexion and extension at the wrist. The use of the 13° offset handled racquet resulted in less preimpact extension, less flexion at impact, and less post-impact flexion and greater post-impact extension than during use of the straight handled racquet, resuslting in increased power without wrist fatigue with the 13° offset handle racquet.

G.

COMPARISON OF RADIAL AND ULNAR DEVIATION OF THE HAND DURING BACKHAND DRIVES (BALL MACHINE CONDITION)

The analyzed data are presented in Table 10.

TABLE 10

COMPARISON OF RADIAL AND ULNAR DEVIATION AT THE WRIST: BACKHAND

| Condition | SH | OH(13°) | Difference OH − SH |
|---|---|---|---|
| Preimpact radial deviation (in degrees) | | | |
| mean | 18 | 23 | 5 |
| s.d. | 2.0 | 2.0 | |
| Impact deviation (in degrees) | | | |
| mean | 6 ulnar | 1 radial | 7 |
| s.d. | 3.9 | 4.5 | |
| Postimpact ulnar deviation (in degrees) | | | |
| mean | 8.9 | 2.8 | −6.1 |
| s.d. | 4.9 | 5.0 | |

A difference exists between the two racquets with respect to radial and ulnar deviation of the hand. During the 13° offset handle condition, there was a more neutral position at the instant of impact and less postimpact ulnar deviation of the hand compared to other handle angles of 15° bent, 19°, 24° and straight handle conditions.

H.

COMPARISON OF SELF DROP DATA

Although the self drop data were analyzed in the same way that the ball machine data were analyzed only the summary of the data are given here. In general the data from the self drop tests were identical to those of the ball machine tests.

I.

APPRAISAL OF PERFORMANCE

Observation of the speed of the ball and the angle of rebound (thus topspin) throughout the test provided evidence of differences in ball speed or rebound spin effects.

IV.

CONCLUSION

The use of the 13° offset handled tennis racquet was more effective than the skilled performer's own straight handled racquet. Significant differences in speed of the ball were found for both the forehand and backhand conditions with the 13° offset handle tennis racquet. Differences in angular changes at the elbow or wrist (both flexion and extension of hand and radial and ulnar deviation of hand) were found between racquet conditions for the forehand drives, which support the advantages of using the 13° offset handle Powergrip tennis racquet. Tests of 150°, 19°, and 20° showed inferior performances as in the case of the straight handle racquet.

Differences were found in angular changes at the elbow between racquet conditions for the backhand drives. During the 13° offset condition there was a more neutral position at the instant of impact and less post-impact ulnar deviation of the hand than during the straight handle condition for the backhand drive, as well as 19° angle. In addition, there was less pre-impact extension, less flexion at impact and less post-impact flexion and greater post-impact extension during the offset racquet condition than during the straight handle condition for the backhand drive.

PHASE TWO

Testing of an Intermediate Leval Tennis Player

The purpose of Phase II was to collect electrogonimetric data from a second subject and compare it with the data from the subject in Phase I.

I.

TESTING PROTOCOL

Electrogoniometers were attached to the subject according to the procedures described in Phase I.

The subject executed forehand and backhand drives utilizing the rotating 5 stroke-block design of Phase 1, self drop condition. No ball machine tests were administered. The Wilson straight handled racquet and the Sentra Powergrip 13° offset handled racquets were used.

II.

RESULTS

Goniograms were obtained and analyzed according to the procedures outlined in Phase I. Patterns were similar to those of the skilled subject's patterns.

Identical results and identical conclusions were drawn with respect to the analysis of the data of this intermediate level tennis player.

The foregoing test results support the basic finding that although conventional straight handles were used on racquets for 100 years that they are inherently designed against the general anatomical make-up of the human hand, and that the straight handle contributes to the general condition known as tennis elbow and tennis wrist.

Secondly, the racquets which have handles that are contoured in excess of 13° a racquet barring have not performed as well as the 13° offset handle. The advantages gained with the use of the 13° contour handle tend to diminish when the racquet handle is bent in excess of 13°.

Thirdly, the players of all skill levels will benefit greatly with the use of the 13° offset handle, in fact, making the tennis racquet a near true extension of the player's arm as opposed to the unnatural position that a straight handle forces the player to use and the exaggerated 15° to 19° angles which are too severe.

PHASE THREE

Comparison of Ball Speeds of Forehand and Backhand Drives and Services Utilizing Offset Handled and Straight Handled Tennis Racquets Phase Three consisted of determining differences in maximal ball speeds achieved by two groups of subjects utilizing the offset Powergrip 13° tennis racquet and straight handled racquets. All tests were self dropped tests in part A in which the subjects hit the ball against a wall. In part B the subjects hit balls from a ball machine. A Jugs radar gun was used to measure the speeds of the ball during forehand and backhand drives and services. The balls were used balls; thus the speeds may be lower than those achieved with new balls. Since differences within subjects, rather than actual speeds, were to be compared the condition of the balls was of no importance.

INTERMEDIATE AND BEGINNING TENNIS LEVEL PERFORMANCES

The subject for this portion of PHASE THREE consisted of six adults (4 males and 2 females). All the subjects have physical education degrees and have participated in sports for many years. One subject currently teaches and plays tennis. Most of the subjects have not played tennis during the past one or more years, but are considered to be low-intermediate to high-intermediate players. The beginning tennis player did perform the service and had no difficulty in performing the backhand with accuracy.

A.

RESULTS

The results of the trials, means of ten to thirteen per stroke, were executed in the five stroke-block sequence utilized in PHASE ONE.

The data show statistically significant differences between the types of grips tested, namely the straight handle, the Sentra 13° handle and the 19° racquets, with respect to speed of ball projection.

B.

APPRAISAL OF PERFORMANCES

The players stated that they "preferred" the 13° offset handle racquet. They stated that they could apply more force, and had more control with the 13° offset handle tennis racquet than with the other grips. They felt that it didn't tend to twist as much and that they had less problem keeping the racquet "in line". On player said that he didn't have to stoop over as far with the 13° offset handle as he did with the other grips.

C.

CONCLUSIONS

These beginning to high-intermediate tennis players when using the 13° offset handle tennis racquet performed better than with the straight or 19° offset handle tennis racquets. Little practice time is required to adapt to the 13° offset handle tennis racquet. One subject who had the least experience with racquets definitely preferred the 13° offset handle racquet and performed better with it. For the majority of subjects there is a feeling that the 13° offset handle racquet enhances spin on the service.

II.

PERFORMANCES OF THE INTERCOLLEGIATE TENNIS TEAM MEMBERS

The subjects for this portion of PHASE THREE consisted of eight members of the intercollegiate tennis teams of Washington State University (4 males and 4 females). All were highly skilled players.

A.

RESULTS

The results of the trials, means of ten trials each of the forehand and backhand drivess and service, are presented in Table 12. The trials were executed in the five stroke-block sequence utilized in PHASE ONE and portion 1 of PHASE THREE. All trials were executed with a ball machine projection.

TABLE 12

MEAN BALL SPEEDS IN MILES PER HOUR FOR MAXIMAL EFFORT FOREHAND AND BACKHAND DRIVES AND SERVICE OF TENNIS TEAM MEMBERS UTILIZING THE 13° OFFSET HANDLE (OH) AND STRAIGHT HANDLE (SH) TENNIS RACQUETS.

| SUBJECT | FOREHAND OH(13°) | SH | BACKHAND OH(13°) | SH | SERVICE OH(13°) | SH |
|---|---|---|---|---|---|---|
| J. S. | 62 | 54 | 58 | 54 | 92 | 86 |
| M. M. | 54 | 48 | 54 | 46 | 63 | 60 |
| S. B. | 61 | 54 | 61 | 55 | 95 | 86 |
| B. J. | 59 | 50 | 56 | 48 | 70 | 62 |
| B. T. | 66 | 58 | 63 | 56 | 88 | 76 |
| E. G. | 58 | 54 | 54 | 45 | 104 | 94 |
| C. M. | 58 | 53 | 60 | 54 | 104 | 92 |
| GROUP | 59 | 53 | 58 | 51 | 88 | 78 |

The results show significant differences between ball speeds for the group using the 13° offset and straight handled tennis racquets.

B.

APPRAISAL OF PERFORMANCES BY PLAYERS OF AVERAGE SKILLS

All the players with basic tennis skills claimed that the 13° offset handle tennis racquet increased their skill level almost immediately. Several said that they were now more competitive with their teacher. Secondly, they claimed universally that it is now possible for them to put topspin on the tennis ball and their serves were substantially faster. All of them claimed it felt much more natural holding the Sentra Powergrip 13° contour handle tennis racquet than the conventional straight handle racquet and 95% said they would never go back to a straight handle.

C.

CONCLUSIONS

Players with above average skills showed a significant improvement in their games as a result of the use of the 13° offset handle vs. the straight handle. Players of better than average skills who used the 13° offset handle tennis racquet claimed their skill level increased immediately due to the use of the offset handle. Also, they had better backhands, less muscle shock and substantially reduced vibration. Also they had much greater topspin as opposed to the straight handle tennis racquet, significantly faster serves and volleys over the straight handle racquet. The general consensus was that a player with a 13° offset handle racket, when compared to the straight handle, has major advantages in evey area of the game when using the 13° offset handle tennis racquet. Several of the players who had tendonidus claimed that the 13° offset handle nearly eliminated the pain associated with the common tennis elbow.

The followng conclusions can be drawn from the data obtained from PHASE ONE (extensive investigation of hand and forearm movements and ball speed of forehand and backhand drives and services). PHASE TWO (repeat of PHASE ONE with an intermediate level tennis player), and PHASE THREE (maximal ball speeds of beginner, intermediate, and intercollegiate tennis team subjects).

1. The Sentra Powergrip 13° offset handle tennis racquet is approximately 20% more effective in producing forehand and backhand drives and services.

2. Players with little or no experience with the Sentra Powergrip can adapt to the racquet readily.

3. Ninety-Five percent (95%) of the players hit the ball faster and with more accuracy with the Sentra Powergrip offset handle than with the straight tennis racquet.

4. A substantial lesser amount of ulnar deviation was noticed with backhand and forehand drive with the offset handle than with the straight handle tennis racquet.

5. For everyone there was a more natural tendency to execute a slice service rather than a flat service and to acquire topspin on the forehand drive.

6. The Sentra Powergrip with the 13° offset handle tennis racquet substantially enhances the performance of the tennis players of all levels both from a theoretical point of view as well as from the test results.

7. Players using the Sentra Powergrip 13° offset handle stated there was substantial less muscle tension than with the straight handle and allowed them to play a stronger game and more consistently than with a straight handle.

The final conclusion can be drawn that although the straight handle tennis racquet has been in use for over 100 years that it is inherently incorrect and that the Sentra Powergrip 13° offset handle achieves the ultimate merging of the tennis player's hand with the racquet from an anatomical point of view. The 13° offset handle is the preferred contour to help increase power and to reduce tennis elbow, tennis wrist, know as tendonidus.

It would be appreciated that although a particular embodiment of the invention has been shown and described, modifications may be made. It is intended in the claims to cover the modifications which come within the spirit and scope of the invention.

What is claimed is:

1. A ball racket comprising a frame having a generally oval shape head having a ball impinging portion having major and minor axes, said head being connected to an offset handle which is angularly disposed by 13° from the major axis of said ball impinging portion and lying in the same plane as the ball impinging portion.

2. A ball racket comprising a frame having a generally oval shape head having major and minor axes, said head being connected to an offset handle which is angularly disposed by substantially 13° from the major axis of said head and lying in the same plane as the head.

3. A ball racket according to claim 1, said offset handle having, in cross section, a plurality of faces extending longitudinally along said handle.

4. A ball racket according to claim 2, said offset handle having, in cross-section, a plurality of faces extending longitudinally along said handle.

5. A ball racket according to claim 3, wherein said faces are arranged in opposing pairs and the faces in each pair are substantially parallel to each other.

6. A racket for tennis or like ball games comprising a frame having a generally annular shape head having a longitudinal axis, an offset handle having a longitudinal axis and a connecting means connecting said handle to said head and having a longitudinal axis in common with the longitudinal axis of the head, the axis of said handle being angularly offset by 13° from the longitudinal axis of said head and said connecting means to define a handle at an angle of 13° from the connecting means and the head lying in the same plane as the head.

7. A tennis racket comprising a frame having a generally annular shape head having a longitudinal axis, an offset handle having a longitudinal axis and a connecting means connecting said handle to said head and having a longitudinal axis in common with the longitudinal axis of the head, the axis of said handle being angularly offset by 13° from the longitudinal axis of said head and said connecting means to define a handle at an angle of 13° from the connecting means and the head lying in the same plane as the head.

8. A ball racket according to claim 7 wherein the cross sectional area of said handle is substantially oval which has a major axis lying in the same plane as the head.

9. A tennis racket comprising a frame having a generally annular shape head having a longitudinal axis, an offset handle having a longitudinal axis and a connecting means connecting said handle to said head and having a longitudinal axis in common with the longitudinal axis of the head, the axis of said handle being angularly offset by substantially 13° from the longitudinal axis of said head and said connecting means to define a handle at an angle of substantially 13° from the connecting means and the head lying in the same plane as the head.

10. A ball racket comprising a frame having a generally oval shape head having major said head being minor axes, and connected to an offset handle which is angularly disposed by substantially 10°–13° from the major axis of said head and lying in the same plane as the head.

11. A tennis racket comprising a frame having a generally annular shape head having a longitudinal axis, an offset handle having a longitudinal axis and a connecting means connecting said handle to said head and having a longitudinal axis in common with the longitudinal axis of the head, the axis of said handle being angularly offset by substantially 10°–13° from the longitudinal axis of said head and said connecting means to define a handle oriented at an angle of 10°–13° from the connecting means and the head and lying in the same plane as the head.

12. The invention according to any one of the preceding claims, wherein the distance between the longitudinal axis of the offset handle and the peripheral surface of said offset handle being generally constant and providing for an offset bent handle of generally uniform thickness throughout the length of the offset handle.

* * * * *